US007889155B2

(12) United States Patent
Moon

(10) Patent No.: US 7,889,155 B2
(45) Date of Patent: Feb. 15, 2011

(54) PLASMA DISPLAY APPARATUS

(75) Inventor: Seonghak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 706 days.

(21) Appl. No.: 11/935,777

(22) Filed: Nov. 6, 2007

(65) Prior Publication Data

US 2008/0122740 A1 May 29, 2008

(30) Foreign Application Priority Data

Nov. 7, 2006 (KR) ..... 10-2006-0109712

(51) Int. Cl.
*G09G 3/28* (2006.01)

(52) U.S. Cl. ..... 345/60; 315/169.1

(58) Field of Classification Search ..... 345/60–68; 315/169.1–169.4
See application file for complete search history.

(56) References Cited

U.S. PATENT DOCUMENTS 4,511,195 A * 4/1985 Barter ..... 315/308
2006/0055635 A1* 3/2006 Choi ..... 345/60
2006/0132391 A1* 6/2006 Onozawa et al. ..... 345/68
2006/0187150 A1* 8/2006 Cho et al. ..... 345/68
2006/0220999 A1* 10/2006 Kim ..... 345/68
2007/0085769 A1* 4/2007 Jin ..... 345/66
2007/0205966 A1* 9/2007 Choi et al. ..... 345/67

FOREIGN PATENT DOCUMENTS

JP 9-251278 A 9/1997
KP 10-2005-0110946 A 11/2005
KR 10-2001-0085292 A 9/2001
KR 10-2005-0093886 A 9/2005

* cited by examiner

*Primary Examiner*—Kimnhung Nguyen
(74) *Attorney, Agent, or Firm*—Birch, Stewart, Kolasch & Birch, LLP

(57) ABSTRACT

A plasma display apparatus is disclosed. The plasma display apparatus includes a plasma display panel including a scan electrode, a sustain voltage supply unit supplying a sustain voltage to the scan electrode, a scan reference voltage supply unit supplying a scan reference voltage to the scan electrode, a scan reference voltage controller that is connected between the scan reference voltage supply unit and the scan electrode and includes a resistor changing the scan reference voltage into a reset signal with a predetermined slope, a voltage storing unit that is connected between the sustain voltage supply unit and the scan reference voltage supply unit and stores the scan reference voltage, and a driving signal output unit that controls an output of a voltage supplied to the scan electrode using a single switch.

23 Claims, 10 Drawing Sheets

PLASMA DISPLAY APPARATUS

This application claims the benefit of Korean Patent Application No. 10-2006-0109712 filed on Nov. 7, 2006, which is hereby incorporated by reference.

BACKGROUND OF THE DISCLOSURE

1. Field of the Disclosure

This document relates to a plasma display apparatus.

2. Description of the Related Art

A plasma display apparatus generally includes a plasma display panel displaying an image and a driver attached to the rear of the plasma display panel to drive the plasma display panel.

The plasma display panel has the structure in which barrier ribs formed between a front panel and a rear panel form unit discharge cell or discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red discharge cell, a green discharge cell, and a blue discharge cell form one pixel.

When the plasma display panel is discharged by applying a high frequency voltage to the discharge cells, the inert gas produces vacuum ultraviolet rays, which thereby cause phosphors formed between the barrier ribs to emit light, thus displaying an image.

The plasma display panel includes a plurality of electrodes, for example, a scan electrode, a sustain electrode, and a data electrode. A plurality of drivers are connected to the plurality of electrodes, respectively, thus applying driving voltages to the plurality of electrodes.

The drivers supply a reset pulse during a reset period, a scan pulse during an address period, and a sustain pulse during a sustain period to the electrodes during the driving of the plasma display panel, thereby displaying an image. Since the plasma display apparatus can be manufactured to be thin and light, it has attracted attention as a next generation display device.

The driving efficiency of the driver depends on various causes such as circuit elements, current paths and driving voltages. Therefore, the study of the improvement in the driving efficiency of the plasma display apparatus has continued.

SUMMARY OF THE DISCLOSURE

In one aspect, a plasma display apparatus comprises a plasma display panel including a scan electrode, a sustain voltage supply unit that supplies a sustain voltage to the scan electrode, a scan reference voltage supply unit that supplies a scan reference voltage to the scan electrode, a scan reference voltage controller that is connected between the scan reference voltage supply unit and the scan electrode and includes a resistor changing the scan reference voltage into a reset signal with a predetermined slope, a voltage storing unit that is connected between the sustain voltage supply unit and the scan reference voltage supply unit and stores the scan reference voltage, and a driving signal output unit that controls an output of a voltage supplied to the scan electrode using a single switch.

The resistor may be connected between the scan reference voltage supply unit and the scan electrode in series.

At least one of a rising slope, a magnitude or supply time of the reset signal may be adjusted by adjusting a resistance value of the resistor.

The resistor may be plural, and the plurality of resistors may be connected to a plurality of scan electrode groups each including at least one scan electrode, respectively.

The plurality of resistors each may have a different resistance value.

The scan reference voltage controller may control at least one of a rising slope, a magnitude or supply time of a reset signal supplied to at least one of the plurality of scan electrode groups to be different from at least one of a rising slope, a magnitude or supply time of a reset signal supplied to the other scan electrode groups.

The driving signal output unit may be a driver integrated circuit (IC) including the single switch connected to each of the plurality of scan electrodes.

The sustain voltage supply unit may include a sustain voltage source, a first switch whose one terminal is connected to the sustain voltage source, a second switch whose one terminal is commonly connected to the other terminal of the first switch and the voltage storing unit, a third switch whose one terminal is connected to the other terminal of the second switch, and a ground level voltage source connected to the other terminal of the third switch. The voltage storing unit may include a first capacitor whose one terminal is commonly connected to the scan reference voltage supply unit and the scan reference voltage controller and the other terminal is connected between the first switch and the second switch, and a first diode connected to the first capacitor in parallel. The scan reference voltage controller may include a fourth switch whose one terminal is connected to the scan reference voltage supply unit, and a resistor whose one terminal is connected to the other terminal of the fourth switch and the other terminal is commonly connected to the scan electrode and one terminal of the driving signal output unit.

When the second switch and the third switch are turned on, the scan reference voltage may be charged to the first capacitor. When the first switch is turned on, the sustain voltage may be supplied to the other terminal of the driving signal output unit, and a sum of the sustain voltage and the scan reference voltage may be supplied to one terminal of the driving signal output unit.

The plasma display apparatus may further comprise a scan voltage supply unit connected between the voltage storing unit and the other terminal of the driving signal output unit.

The scan voltage supply unit may include two switches connected to a scan voltage source in parallel.

In another aspect, a plasma display apparatus comprises a plasma display panel including a scan electrode, a sustain voltage supply unit that supplies a sustain voltage to the scan electrode, a scan reference voltage supply unit that supplies a scan reference voltage to the scan electrode, a scan reference voltage controller that is connected between the scan reference voltage supply unit and the scan electrode and includes a variable resistor changing the scan reference voltage into a reset signal with a predetermined slope, a voltage storing unit that is connected between the sustain voltage supply unit and the scan reference voltage supply unit and stores the scan reference voltage, and a driving signal output unit that controls an output of a voltage supplied to the scan electrode using a single switch.

The variable resistor may be connected between the scan reference voltage supply unit and the scan electrode in series.

At least one of a rising slope, a magnitude or supply time of the reset signal may be adjusted by adjusting a resistance value of the variable resistor.

The scan reference voltage controller may control at least one of a rising slope, a magnitude or supply time of a reset signal supplied to the scan electrode in at least one subfield of a plurality of subfields to be different from at least one of a rising slope, a magnitude or supply time of a reset signal supplied to the scan electrode in the other subfields.

The variable resistor may be plural, and the plurality of variable resistors may be connected to a plurality of scan electrode groups each including at least one scan electrode, respectively.

The sustain voltage supply unit may include a sustain voltage source, a first switch whose one terminal is connected to the sustain voltage source, a second switch whose one terminal is commonly connected to the other terminal of the first switch and the voltage storing unit, a third switch whose one terminal is connected to the other terminal of the second switch, and a ground level voltage source connected to the other terminal of the third switch. The voltage storing unit includes a first capacitor whose one terminal is commonly connected to the scan reference voltage supply unit and the scan reference voltage controller and the other terminal is connected between the first switch and the second switch, and a first diode connected to the first capacitor in parallel. The scan reference voltage controller may include a fourth switch whose one terminal is connected to the scan reference voltage supply unit, and a variable resistor whose one terminal is connected to the other terminal of the fourth switch and the other terminal is commonly connected to the scan electrode and one terminal of the driving signal output unit.

The fourth switch of the scan reference voltage controller may operate in a saturation region.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
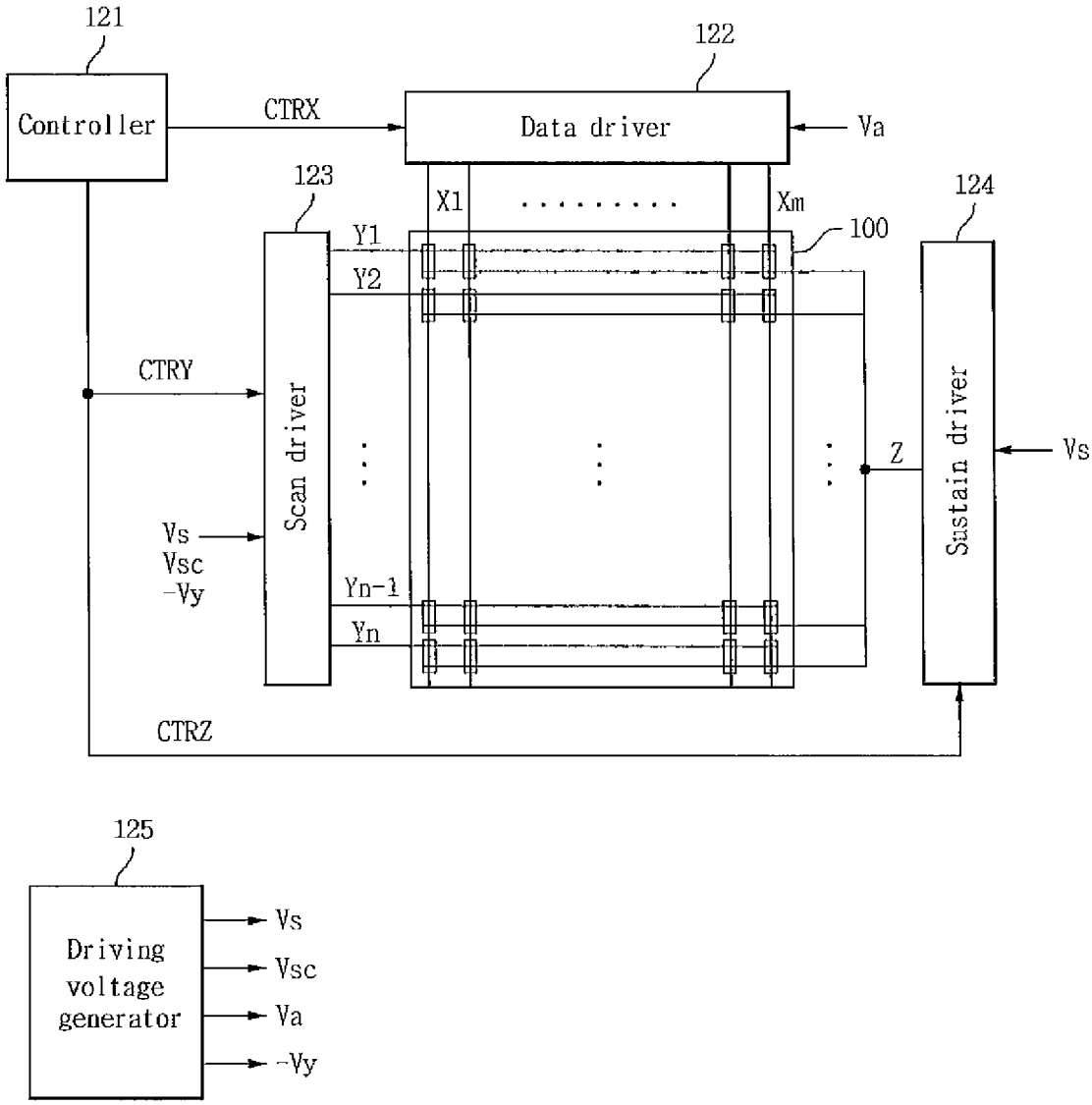
FIG. 1 illustrates a plasma display apparatus according to an exemplary embodiment.

FIG. 1 illustrates a plasma display apparatus according to an exemplary embodiment.

As illustrated in FIG. 1, the plasma display apparatus according to the exemplary embodiment includes a plasma display panel 100, drivers 122, 123 and 124 for driving electrodes of the plasma display panel 100, a controller 121 for controlling the drivers 122, 123 and 124, and a driving voltage generator 125 for supplying a driving voltage necessary to the drivers 122, 123 and 124.

The drivers 122, 123 and 124 includes a data driver 122 for supplying data to address electrodes X1 to Xm, a scan driver 123 for driving scan electrodes Y1 to Yn, a sustain driver 124 for driving sustain electrodes Z being common electrodes.

The plasma display panel 100 includes a front substrate (not shown) and a rear substrate (not shown) which coalesce with each other at a given distance. On the front substrate, a plurality of electrodes, for example, the scan electrodes Y1 to Yn and the sustain electrodes Z are formed in pairs. On the rear substrate, the address electrodes X1 to Xm are formed to intersect the scan electrodes Y1 to Yn and the sustain electrodes Z.

Figure 2:
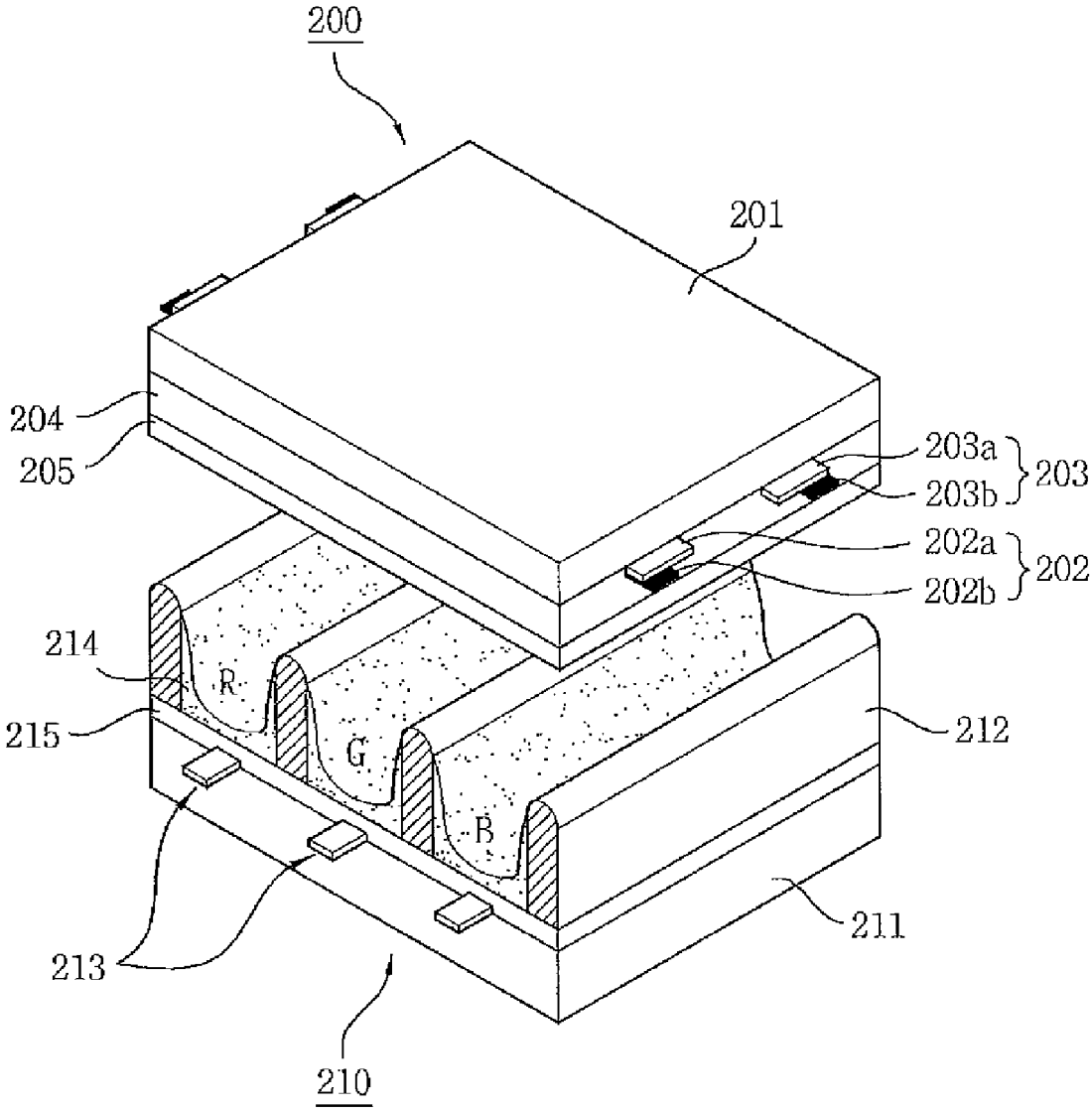
FIG. 2 illustrates the structure of a plasma display panel of FIG. 1.

FIG. 2 illustrates the structure of a plasma display panel of FIG. 1.

As illustrated in FIG. 2, the plasma display panel includes a front panel 200 and a rear panel 210 which are coupled parallel to each other at a given distance. The front panel 200 includes a front substrate 201 being a display surface on which an image is displayed. The rear panel 210 includes a rear substrate 211 constituting a rear surface. A plurality of scan electrodes 202 and a plurality of sustain electrodes 203 are formed in pairs on the front substrate 201 to form a plurality of maintenance electrode pairs. A plurality of address electrodes 213 are formed on the rear substrate 211 to intersect the plurality of maintenance electrode pairs.

The scan electrode 202 and the sustain electrode 203 each include transparent electrodes 202*a* and 203*a* made of a transparent indium-tin-oxide (ITO) material and bus electrodes 202*b* and 203*b* made of a metal material. The scan electrode 102 and the sustain electrode 203 generate a mutual discharge inside one discharge cell and maintain light-emissions of discharge cells. Further, at least one of the scan electrode 202 and the sustain electrode 203 may include either the transparent electrodes 202*a* and 203*a* or the bus electrodes 202*b* and 203*b*. The scan electrode 202 and the sustain electrode 203 are covered with one or more upper dielectric layers 204 for limiting a discharge current and providing insulation between the maintenance electrode pairs. A protective layer 205 with a deposit of MgO is formed on an upper surface of the upper dielectric layer 204 to facilitate discharge conditions.

A plurality of stripe-type (or well-type) barrier ribs 212 are formed parallel to each other on the rear substrate 211 so as to form a plurality of discharge spaces (i.e., a plurality of discharge cells). The plurality of address electrodes 213 for performing an address discharge to generate vacuum ultraviolet rays are arranged parallel to the barrier ribs 212. An upper surface of the rear substrate 211 is coated with Red (R), green (G) and blue (B) phosphors 214 for emitting visible light for an image display during an address discharge. A lower dielectric layer 215 is formed between the address electrodes 213 and the phosphors 214 to protect the address electrodes 213.

The front panel 200 and the rear panel 210 thus formed coalesce with each other using a sealing process to complete the plasma display panel. The drivers for driving the scan electrode 202, the sustain electrode 203 and the address electrode 213 are attached to the plasma display panel to complete the plasma display apparatus.

Figure 3:
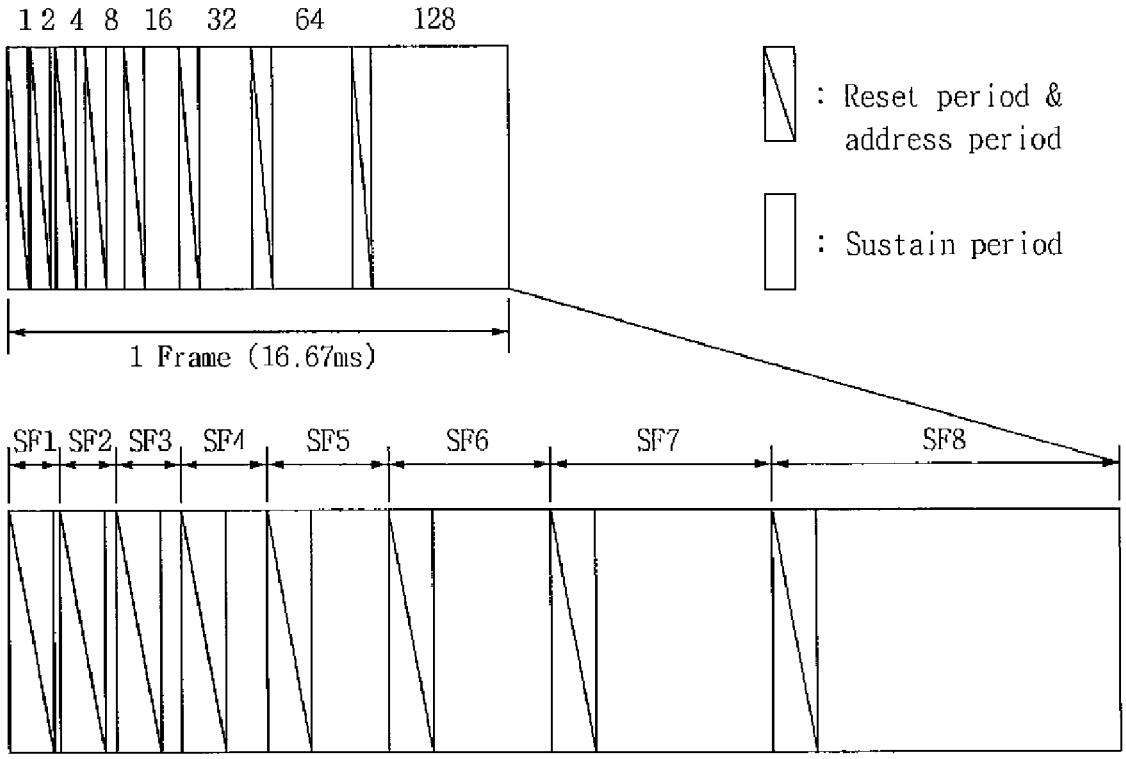
FIG. 3 illustrates a frame for achieving a gray scale of an image in the plasma display apparatus according to the exemplary embodiment.

FIG. 3 illustrates a frame for achieving a gray scale of an image in the plasma display apparatus according to the exemplary embodiment.

As illustrated in FIG. 3, the plasma display apparatus for displaying an image on the plasma display panel may be driven with one frame being divided into a plurality of subfields. For instance, each subfield is subdivided into a reset period for initializing all the discharge cells, an address period for selecting cells to be discharged, and a sustain period for representing a gray level in accordance with the number of discharges.

For instance, if an image with 256-level gray scale is to be displayed, a frame period (i.e., 16.67 ms) corresponding to 1/60 second is divided into a plurality of subfields, for instance, 8 subfields SF1 to SF8. Each of the 8 subfields SF1 to SF8 is subdivided into a reset period, an address period, and a sustain period. A time width of a reset period in each subfield may be equal to one another, and also a time width of an address period in each subfield may be equal to one another. On the other hand, a time width of a sustain period in each subfield may be different from one another, and the number of sustain signals assigned during the sustain period of each subfield may be different from one another. For instance, a time width of each sustain period may increase in a ratio of $2^n$ (where, n=0, 1, 2, 3, 4, 5, 6, 7) in each subfield, and thus a gray scale can be represented.

Referring to again FIG. 1, under the control of the controller 121, the scan driver 123 supplies a reset signal including a setup signal of a rising signal and a set-down signal of a falling signal to the scan electrodes Y1 to Yn during a reset period of a subfield so as to initialize wall charges distributed inside all the discharge cells in a previous subfield. The setup signal may be supplied using a sum of a sustain voltage Vs and a scan reference voltage Vsc, and the set-down signal may be supplied using a scan voltage −Vy. A slope of the setup signal and a slope of the set-down signal may be adjusted. This will be described later with reference to FIG. 5.

The scan driver 123 sequentially supplies scan signals having the scan reference voltage Vsc and the scan voltage −Vy to the scan electrodes Y1 to Yn during an address period.

The scan driver 123 supplies a sustain signal to the scan electrodes Y1 to Yn during a sustain period.

The scan driver 123 includes a driving signal output unit (for instance, a scan driver integrated circuit (IC)) capable of controlling an output of a voltage supplied to each scan electrode using one switch in each scan electrode, and thus the driving efficiency can rise. This will be described later with reference to FIG. 5.

The data driver 122 receives data mapped for each subfield by a subfield mapping circuit (not shown) after being inverse-gamma corrected and error-diffused through an inverse gamma correction circuit (not shown) and an error diffusion circuit (not shown), or the like. The data driver 122 samples and latches the mapped data in response to a timing control signal CTRX supplied from the controller 121, and then supplies the data to the address electrodes X1 to Xm. Discharge cells where a sustain discharge will occur during the sustain period are selected depending on the data.

Wall charges are produced inside the discharge cells, to which the data is supplied, to the extent that when the sustain signal is supplied during the sustain period the sustain discharge occurs.

Under the control of the controller 121, the sustain driver 124 supplies a positive voltage Vz to the sustain electrodes Z.

The sustain driver 124 supplies a sustain signal to the sustain electrodes Z during the sustain period. A sustain driving circuit included in the sustain driver 124 and a sustain driving circuit included in the scan driver 123 alternately supply the sustain signals to the scan electrodes Y and the sustain electrodes Z, and thus the sustain discharge occurs.

The controller 121 receives a vertical/horizontal synchronization signal and a clock signal and produces timing control signals CTRX, CTRY and CTRZ for controlling operation timing and synchronization of each driver 122, 123 and 124 during the reset, address and sustain periods. The controller 121 supplies the timing control signals CTRX, CTRY and CTRZ to the corresponding drivers 122, 123 and 124 to control each driver 122, 123 and 124.

The data control signal CTRX includes a sampling clock for sampling data, a latch control signal, and a switch control signal for controlling on/off time of the sustain driving circuit and a driving switch element. The scan control signal CTRY includes a switch control signal for controlling on/off time of the sustain driving circuit and a driving switch element inside the scan driver 123. The sustain control signal CTRZ includes a switch control signal for controlling on/off time of the sustain driving circuit and a driving switch element inside the sustain driver 124.

The driving voltage generator 125 generates driving voltages necessary to drive the plasma display panel 100, for instance, a setup voltage Vsetup, a scan common voltage Vsc, a scan voltage −Vy, a sustain voltage Vs, and a data voltage Va. These driving voltages may vary depending on a composition of the discharge gas or the structure of the discharge cell.

Figure 4:
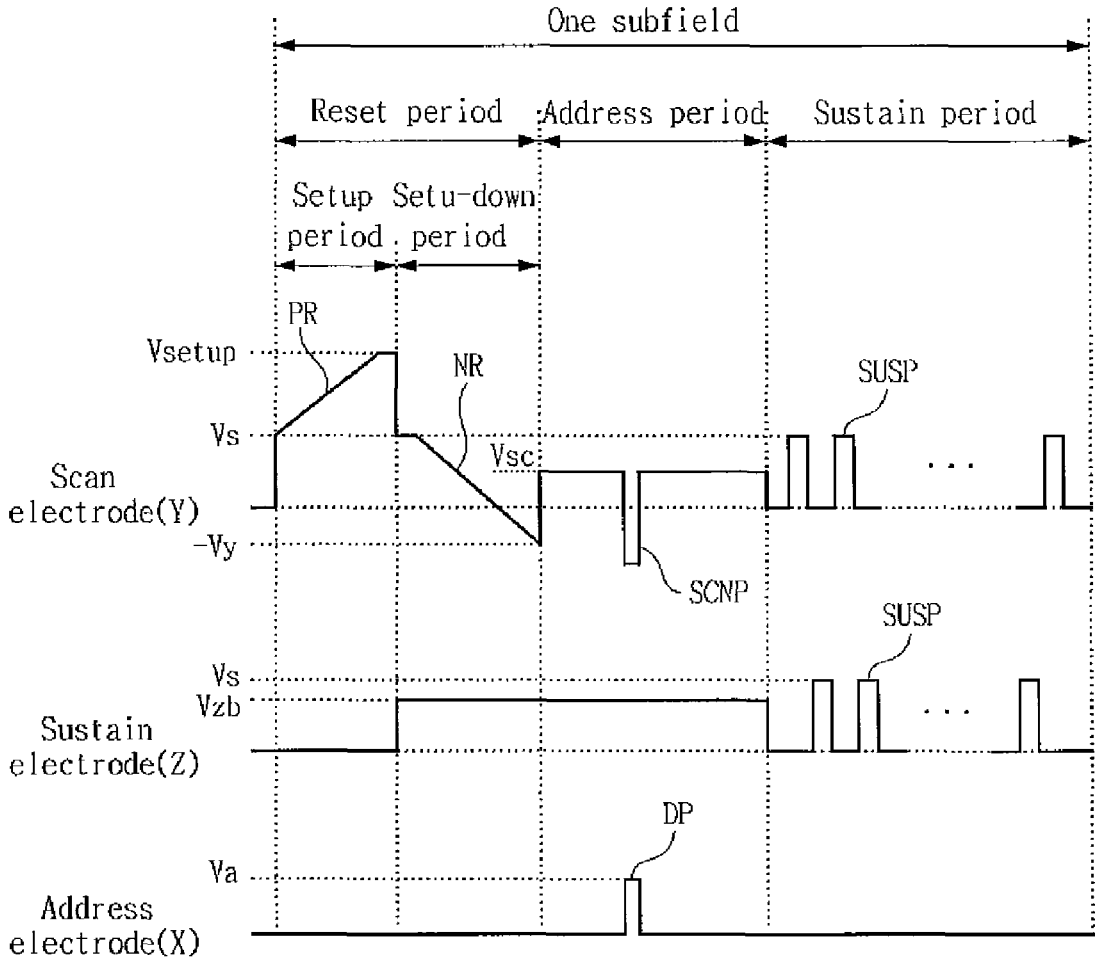
FIG. 4 illustrates an operation of the plasma display apparatus according to the exemplary embodiment.

FIG. 4 illustrates an operation of the plasma display apparatus according to the exemplary embodiment.

In FIG. 4, a driving waveform of the plasma display apparatus is illustrated in one subfield.

The subfield is divided into a reset period for initializing all the discharge cells of the whole screen, an address period for selecting cells to be discharged, and a sustain period for maintaining a discharge inside the selected discharge cells.

The reset period is subdivided into a setup period and a set-down period. During the setup period, a setup signal PR whose a voltage level gradually rises to a high voltage is simultaneously supplied to all the scan electrodes Y, thereby generating a weak dark discharge (i.e., a setup discharge) inside the discharge cells of the whole screen. Hence, wall charges are produced inside the discharge cells. The setup signal PR may be supplied using a sum of the sustain voltage Vs and the scan reference voltage Vsc. A slope of the setup signal PR may be adjusted depending on each scan electrode or each subfield. This will be described later with reference to FIG. 5.

During the set-down period, a set-down signal NR whose a voltage level gradually falls is simultaneously supplied to the scan electrodes Y, thereby generating a weak erase discharge (i.e., a set-down discharge) inside the discharge cells. Hence, the wall charges excessively produced by the setup discharge are erased so that the remaining wall charges are uniformly distributed inside the discharge cells. The set-down signal NR may be supplied using the scan voltage −Vy.

During the address period, a scan signal SCNP having a voltage lower than a lowest voltage −Vy of the set-down signal NR is supplied to the scan electrodes Y and at the same time, a data signal DP is supplied to the address electrodes X. Hence, a voltage of the data signal DP can be lowered, and thus energy consumption can be reduced. As the voltage difference between the scan signal SCNP and the data signal DP is added to a wall voltage produced during the reset period, an address discharge occurs inside the discharge cells to which the data signal DP is supplied. Wall charges are produced inside the discharge cells where the address discharge occurs.

A positive voltage Vzb is applied to the sustain electrodes Z to the extent that a discharge does not occur due to a voltage difference between the sustain electrodes Z and the scan electrodes Y.

During the sustain period, sustain signals SISP are alternately supplied to the scan electrodes Y and the sustain electrodes Z, thereby generating a sustain discharge.

Because a path for supplying the driving voltage to the scan electrode in the driver is short, an impedance of a circuit can be minimized. A configuration of the driver will be described below with reference to FIG. 5.

Figure 5:
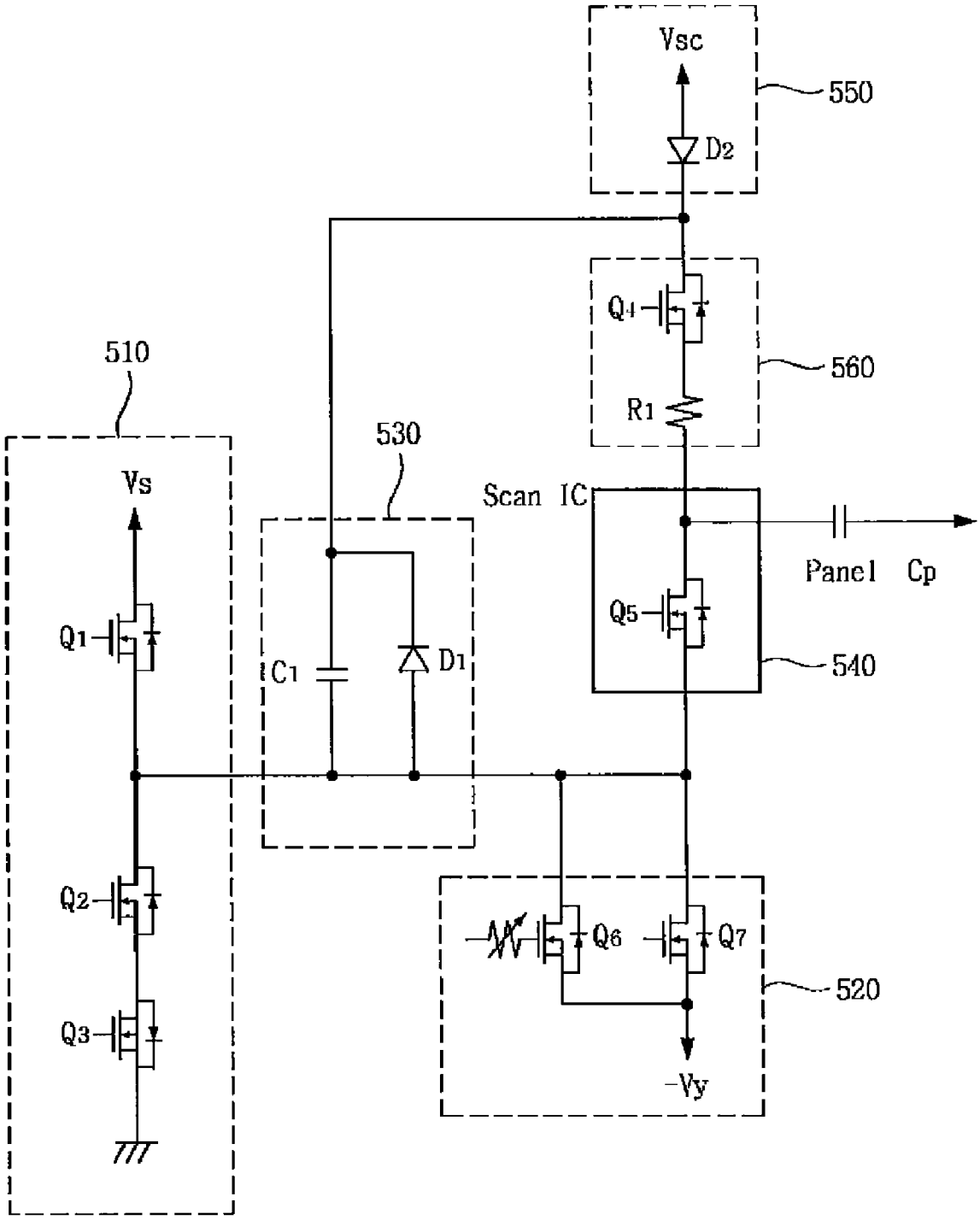
FIG. 5 is a circuit diagram of a driver of the plasma display apparatus according to the exemplary embodiment.

FIG. 5 is a circuit diagram of a driver of the plasma display apparatus according to the exemplary embodiment.

As illustrated in FIG. 5, the scan driver includes a sustain voltage supply unit 510, a voltage storing unit 530, a driving signal output unit 540, a scan reference voltage supply unit 550, and a scan reference voltage controller 560. The scan driver may further include a scan voltage supply unit 520.

The sustain voltage supply unit 510 supplies a sustain voltage and a ground level voltage to the scan electrode Y. The sustain voltage supply unit 510 includes a sustain voltage source Vs, a first switch Q1 whose one terminal is connected to the sustain voltage source Vs, a second switch Q2 whose one terminal is commonly connected to the other terminal of the first switch Q1 and the voltage storing unit 530, a third switch Q3 whose one terminal is connected to the other terminal of the second switch Q2, and a ground level voltage source connected to the other terminal of the third switch Q3.

The scan reference voltage supply unit 550 supplies a scan reference voltage to the scan electrode Y. The scan reference voltage supply unit 550 includes a scan reference voltage source Vsc and a second diode D2.

The voltage storing unit 530 is connected between the sustain voltage supply unit 510 and the scan reference voltage supply unit 550, and stores the scan reference voltage Vsc. The voltage storing unit 530 includes a first capacitor C1 whose one terminal is commonly connected to the scan reference voltage supply unit 550 and the scan reference voltage controller 560 and the other terminal is connected between the first switch Q1 and the second switch Q2, and a first diode D1 connected to the first capacitor C1 in parallel.

When the second switch Q2 and the third switch Q3 of the sustain voltage supply unit 510 are turned on, the scan reference voltage Vsc is charged to the first capacitor C1. When the first switch Q1 of the sustain voltage supply unit 510 is turned on, the sustain voltage Vs is supplied to the other terminal of the driving signal output unit 540, and a sum (Vs+Vsc) of the sustain voltage Vs and the scan reference voltage Vsc is supplied to one terminal of the driving signal output unit 540. In other words, the first capacitor C1 stores the scan reference voltage Vsc supplied from the scan reference voltage supply unit 550. Then, when the sustain voltage source Vs supplies the sustain voltage Vs, a voltage level of the other terminal of the first capacitor C1 rises to the sustain voltage Vs, and thus a sum (Vs+Vsc) of the sustain voltage Vs and the scan reference voltage Vsc is supplied to the scan electrode Y. As a result, since a voltage magnitude of the driving signal output unit 540 is reduced, a stability of a circuit operation of the driver can be improved and the driver can be driven at a low voltage.

The driving signal output unit 540 includes a single switch Q5 connected to each scan electrode and controls an output of a voltage supplied to the scan electrode. In other words, the driving signal output unit 540 may be formed in the form of a driver IC including the single switch Q5 connected to each of the plurality of scan electrodes. The driver IC may use an open drain type switch.

One switch Q5 is connected to one scan electrode and controls an output of a voltage supplied to the scan electrode. Because the number of switches of the driving signal output unit 540 is less than the number of switches of a related art driving signal output unit, the manufacturing cost can be reduced. Further, because an insulation space of the driver IC can be secured, the operation reliability can be improved.

The scan voltage supply unit 520 is connected between the voltage storing unit 530 and the other terminal of the driving signal output unit 540 to supply the scan voltage −Vy to the scan electrode Y. The scan voltage supply unit 520 includes two switches, that is, sixth and seventh switches Q6 and Q7 connected to the scan voltage source −Vy in parallel. In other words, the set-down signal with a predetermined slope is supplied using a path through the sixth switch Q6 including a variable resistor for the predetermined slope, and the scan signal is supplied using a path through the seventh switch Q7 for the supply of a direct current. Therefore, the stability of the circuit operation can be improved.

The scan reference voltage controller 560 is connected between the scan reference voltage supply unit 550 and the scan electrode Y to supply the reset signal with a predetermined slope to the scan electrode Y. In other words, when the reset signal is supplied to the scan electrode Y using a sum (Vs+Vsc) of the sustain voltage Vs and the scan reference voltage Vsc, a slope, a magnitude and supply time of the reset signal can be controlled. This will be described later with reference to FIG. 6.

The scan reference voltage controller 560 includes a fourth switch Q4 whose one terminal is connected to the scan reference voltage supply unit 550, and a resistor R1 whose one terminal is connected to the other terminal of the fourth switch Q4 and the other terminal is commonly connected to the scan electrode Y and one terminal of the driving signal output unit 540.

Further, a rising slope, a magnitude and supply time of the reset signal supplied to the scan electrode can be controlled by connecting the plurality of resistors R1 to a plurality of scan electrode groups each including at least one scan electrode, respectively. In other words, the rising slope of the reset signal is controlled by setting resistance values of the plurality of resistors R1 to be different from each other. Further, the magnitude and the supply time of the reset signal are controlled. This will be described later with reference to FIG. 7.

The driving circuit of the plasma display apparatus according to the exemplary embodiment can minimize a length of a current path. In other words, switches with a high level withstanding voltage characteristic included in a path for supplying the sustain voltage Vs or a path for supplying the scan reference voltage Vsc are removed in the exemplary embodiment, and also a length of the path shortens. Hence, a driving waveform output to the scan electrode is supplied without distortion, and a noise is minimized. Further, because an influence of a voltage drop or a load appearing on a current path is reduced and an output impedance of the driving circuit is reduced, the circuit efficiency can be improved. An influence of electromagnetic interference (EMI) can be reduced.

Figure 6:
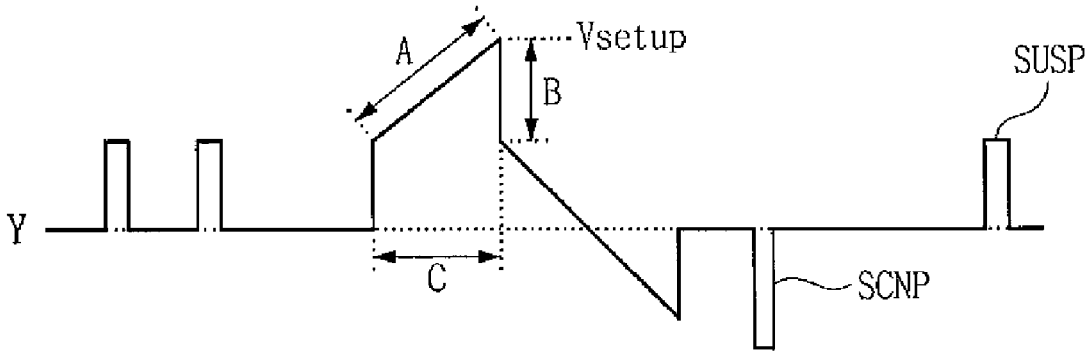
FIG. 6 illustrates a driving waveform produced by a driving circuit.

FIG. 6 illustrates a driving waveform produced by a driving circuit of the plasma display apparatus according to the exemplary embodiment.

As illustrated in FIG. 6, the reset signal may be supplied using a sum of the sustain voltage Vs and the scan reference voltage Vsc. In other words, the reset signal rises to the sustain voltage Vs and then rises with a predetermined slope by a magnitude of the scan reference voltage Vsc. As above, a rising slope (A) of the reset signal can be adjusted by adjusting a resistance value of the resistor R1 of the scan reference voltage controller 560, and thus a magnitude (B) or a supply time (C) of the reset signal can be adjusted by adjusting timing of the switch.

The magnitude, the rising slope, or the supply time of the reset signal can be adjusted in each subfield. For instance, an intensity of a discharge strengthens by increasing a magnitude, a rising slope, or supply time of a reset signal in a first subfield, and thus the discharge cells can be efficiently saturated with wall charges. Further, when a reset signal is applied during a reset period of a first subfield of a plurality of subfields and the reset signal is again applied in a subfield after a middle subfield of the plurality of subfields, wall charges can be efficiently controlled by adjusting a magnitude, a rising slope, or supply time of the reset signal.

The magnitude, the rising slope, or the supply time of the reset signal can be adjusted depending on each scan electrode.

Figure 7:
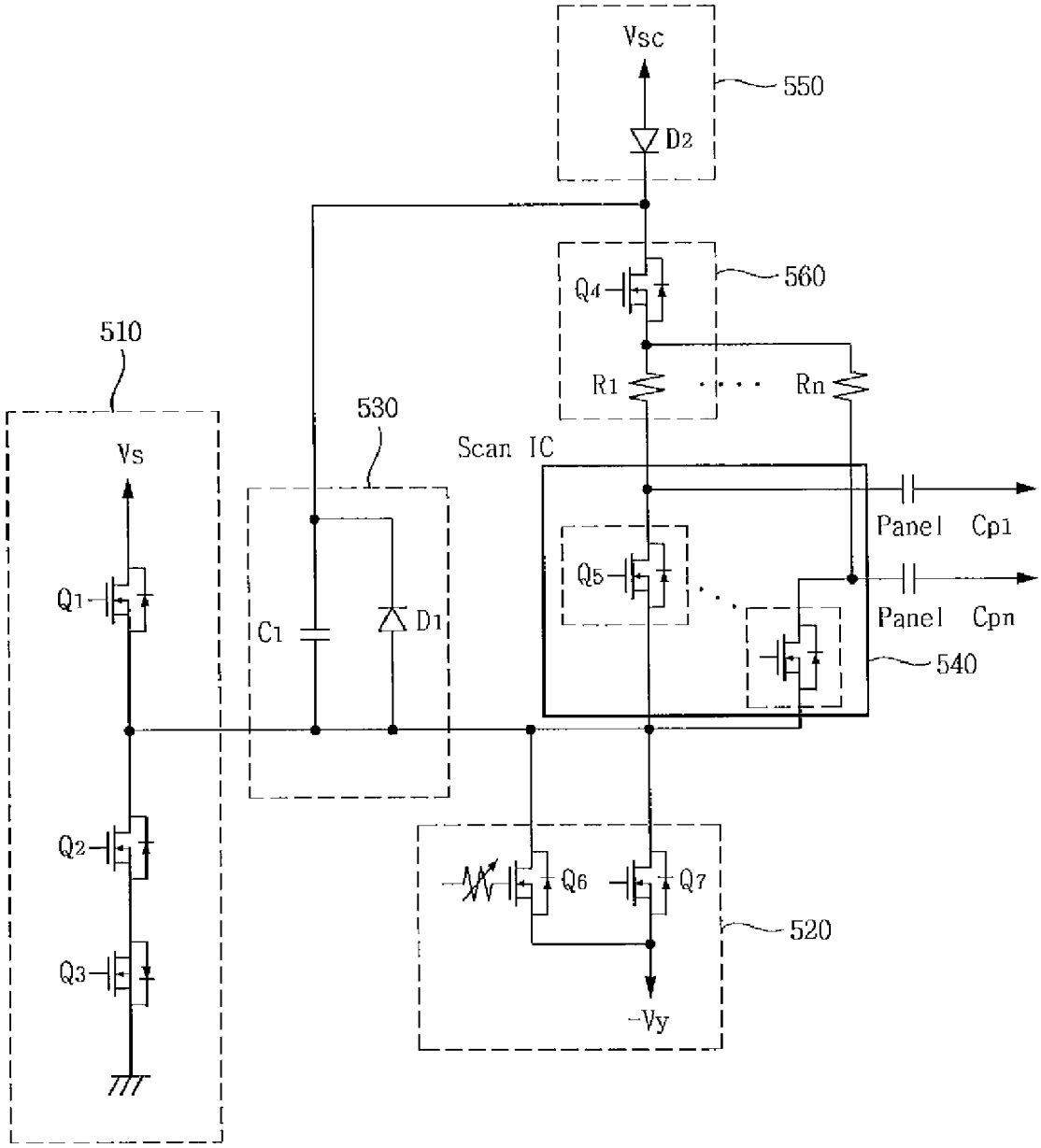
FIG. 7 is a diagram for explaining a relationship between the driver and a plurality of scan electrodes.

FIG. 7 is a diagram for explaining a relationship between the driver and a plurality of scan electrodes.

As illustrated in FIG. 7, the driving signal output unit 540 is formed in the form of a driver IC including a single switch Q5 connected to each of the plurality of scan electrodes Y1 to Yn. The driving signal output unit 540 can control a voltage output to each scan electrode Y1 to Yn.

The fourth switch Q4 of the scan reference voltage controller 560 is commonly connected to the plurality of scan electrodes Y1 to Yn, and the resistors R1 to Rn are connected to the plurality of scan electrodes Y1 to Yn, respectively. Hence, at least one of the magnitude, the rising slope or the supply time of the reset signal can be adjusted depending on each scan electrode.

For instance, the plurality of resistors R1 to Rn are connected to a plurality of scan electrode groups each including at least one scan electrode, respectively, and thus each of the magnitude, the rising slope and the supply time of the reset signal supplied to the scan electrode can be adjusted.

Figure 8:
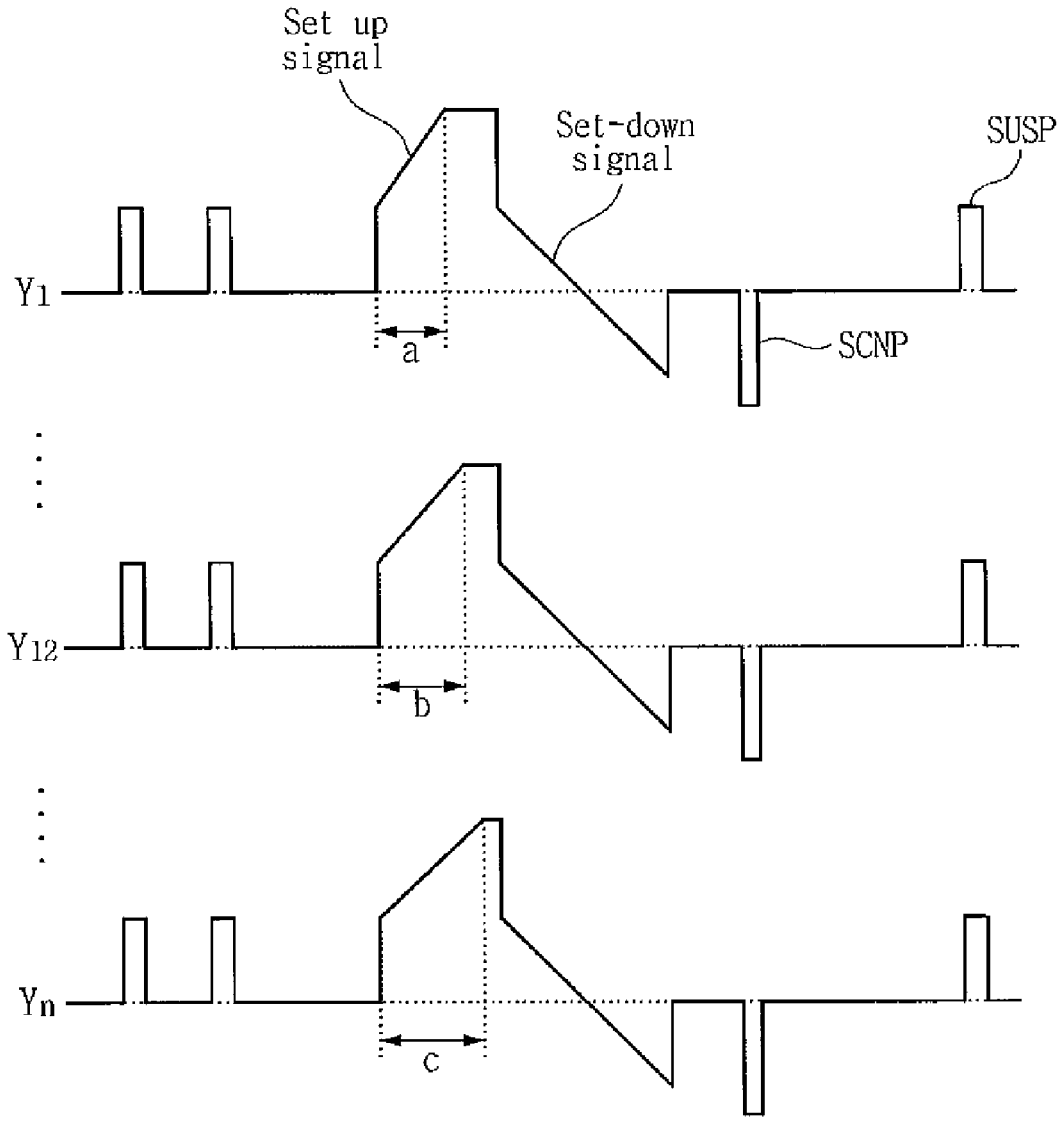
FIG. 8 illustrates a driving waveform of the plurality of scan electrodes produced by the driver of FIG. 7.

FIG. 8 illustrates a driving waveform of the plurality of scan electrodes produced by the driver of FIG. 7.

As illustrated in FIG. 8, slopes of reset signals supplied to the plurality of scan electrodes Y1 to Yn may sequentially increase. For instance, a slope of a reset signal supplied to the scan electrode Y1 is smallest, a slope of a reset signal supplied to the scan electrode Y12 is larger than the slope of the reset signal supplied to the scan electrode Y1, and a slope of a reset signal supplied to the last scan electrode Yn is largest. In this case, as the slope of the reset signal increases, the erased amount of wall charges can be efficiently secured. Hence, an address discharge and a sustain discharge can occur accurately.

As above, wall charges can be efficiently controlled by adjusting the magnitude, the rising slope and the supply time of the reset signal, and thus the driving of the plasma display apparatus can be optimized.

Figure 9:
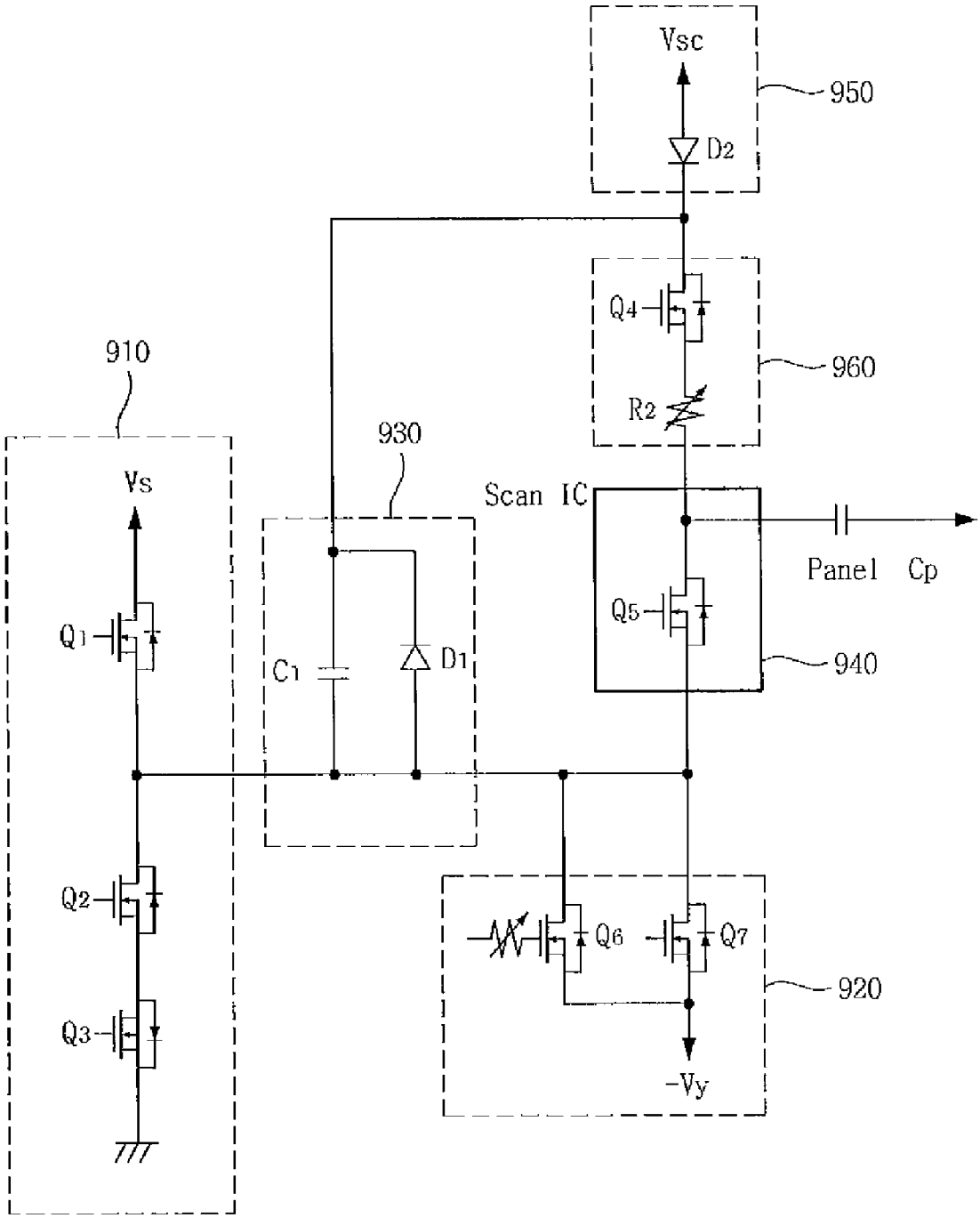
FIG. 9 is another circuit diagram of the driver of the plasma display apparatus according to the exemplary embodiment.

FIG. 9 is another circuit diagram of the driver of the plasma display apparatus according to the exemplary embodiment.

As illustrated in FIG. 9, the scan driver includes a sustain voltage supply unit 910, a voltage storing unit 930, a driving signal output unit 940, a scan reference voltage supply unit 950, and a scan reference voltage controller 960. The scan driver may further include a scan voltage supply unit 920.

The sustain voltage supply unit 910 supplies a sustain voltage and a ground level voltage to the scan electrode Y. The sustain voltage supply unit 910 includes a sustain voltage source Vs, a first switch Q1 whose one terminal is connected to the sustain voltage source Vs, a second switch Q2 whose one terminal is commonly connected to the other terminal of the first switch Q1 and the voltage storing unit 930, a third switch Q3 whose one terminal is connected to the other terminal of the second switch Q2, and a ground level voltage source connected to the other terminal of the third switch Q3.

The scan reference voltage supply unit 950 supplies a scan reference voltage to the scan electrode Y. The scan reference voltage supply unit 950 includes a scan reference voltage source Vsc and a second diode D2.

The voltage storing unit 930 is connected between the sustain voltage supply unit 910 and the scan reference voltage supply unit 950, and stores the scan reference voltage Vsc. The voltage storing unit 930 includes a first capacitor C1 whose one terminal is commonly connected to the scan reference voltage supply unit 950 and the scan reference voltage controller 960 and the other terminal is connected between the first switch Q1 and the second switch Q2, and a first diode D1 connected to the first capacitor C1 in parallel.

When the second switch Q2 and the third switch Q3 of the sustain voltage supply unit 910 are turned on, the scan reference voltage Vsc is charged to the first capacitor C1. When the first switch Q1 of the sustain voltage supply unit 910 is turned on, the sustain voltage Vs is supplied to the other terminal of the driving signal output unit 940, and a sum (Vs+Vsc) of the sustain voltage Vs and the scan reference voltage Vsc is supplied to one terminal of the driving signal output unit 940. In other words, the first capacitor C1 stores the scan reference voltage Vsc supplied from the scan reference voltage supply unit 950. Then, when the sustain voltage source Vs supplies the sustain voltage Vs, a voltage level of the other terminal of the first capacitor C1 rises to the sustain voltage Vs, and thus a sum (Vs+Vsc) of the sustain voltage Vs and the scan reference voltage Vsc is supplied to the scan electrode Y. As a result, since a voltage magnitude of the driving signal output unit 940 is reduced, a stability of a circuit operation of the driver can be improved and the driver can be driven at a low voltage.

The driving signal output unit 940 includes a single switch Q5 connected to each scan electrode and controls an output of a voltage supplied to the scan electrode. In other words, the driving signal output unit 940 may be formed in the form of a driver IC including the single switch Q5 connected to each of the plurality of scan electrodes. The driver IC may use an open drain type switch.

One switch Q5 is connected to one scan electrode and controls an output of a voltage supplied to the scan electrode. Because the number of switches of the driving signal output unit 540 is less than the number of switches of a related art driving signal output unit, the manufacturing cost can be reduced. Further, because an insulation space of the driver IC can be secured, the operation reliability can be improved.

The scan voltage supply unit 920 is connected between the voltage storing unit 930 and the other terminal of the driving signal output unit 940 to supply the scan voltage −Vy to the scan electrode Y. The scan voltage supply unit 920 includes two switches, that is, sixth and seventh switches Q6 and Q7 connected to the scan voltage source −Vy in parallel. In other words, the set-down signal with a predetermined slope is supplied using a path through the sixth switch Q6 including a variable resistor for the predetermined slope, and the scan signal is supplied using a path through the seventh switch Q7 for the supply of a direct current. Therefore, the stability of the circuit operation can be improved.

The scan reference voltage controller 960 is connected between the scan reference voltage supply unit 950 and the scan electrode Y to supply a reset signal with a predetermined slope to the scan electrode Y. In other words, when the reset signal is supplied to the scan electrode Y using a sum (Vs+Vsc) of the sustain voltage Vs and the scan reference voltage Vsc, a slope, a magnitude and supply time of the reset signal can be controlled.

The scan reference voltage controller 960 includes a fourth switch Q4 whose one terminal is connected to the scan reference voltage supply unit 950, and a variable resistor Ra whose one terminal is connected to the other terminal of the fourth switch Q4 and the other terminal is commonly connected to the scan electrode Y and one terminal of the driving signal output unit 940. The rising slope, the magnitude and the supply time of the reset signal can be controlled by connecting a resistance value of the variable resistor Ra. Further, the fourth switch Q4 can employ a saturation region thereof by using the variable resistor Ra. In other words, since the fourth switch Q4 employs not an active region but the saturation region thereof, heat generated in the fourth switch Q4 during the voltage supply is reduced.

The scan reference voltage controller 960 controls at least one of a rising slope, a magnitude and supply time of a reset signal supplied to the scan electrode Y in at least one subfield of a plurality of subfields to be different from at least one of a rising slope, a magnitude and supply time of a reset signal supplied to the scan electrode Y in the other subfields, and thus wall charges inside the discharge cells can be efficiently controlled.

Further, a rising slope, a magnitude or supply time of a reset signal supplied to the scan electrode are controlled by connecting the plurality of variable resistors Ra to a plurality of scan electrode groups each including at least one scan electrode, respectively, and thus wall charges can be adjusted depending on each scan electrode. For instance, switch timing is adjusted by adjusting the rising slope of the reset signal, and thus the magnitude or the supply time of the reset signal can be adjusted. This will be described later with reference to FIG. 10.

Figure 10:
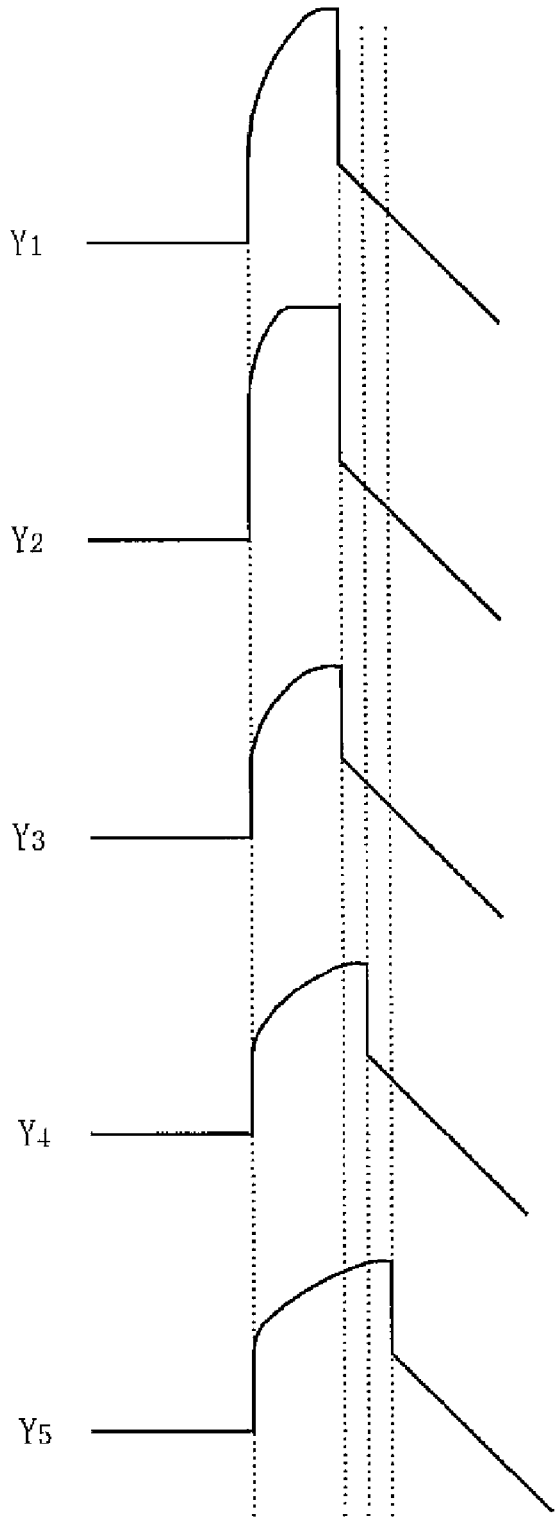
FIG. 10 illustrates a driving waveform produced by the driver of FIG. 9.

FIG. 10 illustrates a driving waveform produced by the driver of FIG. 9.

The rising slope, the magnitude and the supply time of the reset signal supplied to the scan electrode are controlled. As illustrated in FIG. 10, a rising slope, a magnitude and supply time of each of reset signals supplied to the scan electrodes Y1 to Y5 can be controlled. Accordingly, wall charges inside the discharge cells are efficiently controlled, and thus the driving of the plasma display apparatus can be optimized.

The driving circuit of the plasma display apparatus according to the exemplary embodiment can minimize a length of a current path. In other words, switches with a high-level withstanding voltage characteristic included in a path for supplying the sustain voltage Vs or a path for supplying the scan reference voltage Vsc are removed in the exemplary embodiment, and also a length of the path shortens. Hence, a driving waveform output to the scan electrode is supplied without distortion, and a noise is minimized. Further, because an influence of a voltage drop or a load appearing on a current path is reduced and an output impedance of the driving circuit is reduced, the circuit efficiency can be improved. An influence of electromagnetic interference (EMI) can be reduced.

Further, an address discharge and a sustain discharge following a reset discharge can accurately occur by optimizing discharge conditions of the reset discharge.

As above, in the plasma display apparatus according to the exemplary embodiment, since the length of the current path shortens, the reliability of the circuit operation can be improved. Further, a noise of driving waveform can be reduced and the driving efficiency can be improved.

Furthermore, in the plasma display apparatus according to the exemplary embodiment, heat generated in the driving circuit can be reduced. The wall charges can be controlled and the influence of EMI can be reduced. Since the number of circuit elements is reduced, the manufacturing cost can be reduced.

Embodiments of the invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A plasma display apparatus comprising:

a plasma display panel including a scan electrode;

a sustain voltage supply unit that supplies a sustain voltage to the scan electrode;

a scan reference voltage supply unit that supplies a scan reference voltage to the scan electrode;

a scan reference voltage controller that is connected between the scan reference voltage supply unit and the scan electrode and includes a resistor changing the scan reference voltage into a reset signal with a predetermined slope;

a voltage storing unit that is connected between the sustain voltage supply unit and the scan reference voltage supply unit and stores the scan reference voltage; and a driving signal output unit that controls an output of a voltage supplied to the scan electrode using a single switch, wherein a first terminal of the resistor of the scan reference voltage controller is directly connected to the scan reference voltage supply unit and a second terminal of the resistor of the scan reference voltage controller is directly connected to the scan electrode and the driving signal output unit, and a first terminal of the single switch of the driving signal output unit is directly connected to the scan electrode and the resistor of the scan reference voltage controller and a second terminal of the single switch of the driving signal output unit is directly connected to the voltage storing unit and the sustain voltage supply unit.

2. The plasma display apparatus of claim 1, wherein at least one of a rising slope, a magnitude or supply time of the reset signal is adjusted by adjusting a resistance value of the resistor.

3. The plasma display apparatus of claim 1, wherein the resistor includes a plurality of resistors, and the plurality of resistors are connected to a plurality of scan electrode groups each including at least one scan electrode, respectively.

4. The plasma display apparatus of claim 3, wherein the plurality of resistors each have a different resistance value.

5. The plasma display apparatus of claim 3, wherein the scan reference voltage controller controls at least one of a rising slope, a magnitude or supply time of a reset signal supplied to at least one of the plurality of scan electrode groups to be different from at least one of a rising slope, a magnitude or supply time of a reset signal supplied to the other scan electrode groups.

6. The plasma display apparatus of claim 1, wherein the driving signal output unit is a driver integrated circuit (IC) including the single switch connected to each of the plurality of scan electrodes.

7. The plasma display apparatus of claim 1, wherein the sustain voltage supply unit includes a sustain voltage source, a first switch whose one terminal is connected to the sustain voltage source, a second switch whose one terminal is commonly connected to the other terminal of the first switch and the voltage storing unit, a third switch whose one terminal is connected to the other terminal of the second switch, and a ground level voltage source connected to the other terminal of the third switch, and the voltage storing unit includes a first capacitor whose one terminal is commonly connected to the scan reference voltage supply unit and the scan reference voltage controller and the other terminal is connected between the first switch and the second switch, and a first diode connected to the first capacitor in parallel, and the scan reference voltage controller includes a fourth switch whose one terminal is connected to the scan reference voltage supply unit, and the resistor whose one terminal is connected to the other terminal of the fourth switch and the other terminal is commonly connected to the scan electrode and one terminal of the driving signal output unit.

8. The plasma display apparatus of claim 7, wherein when the second switch and the third switch are turned on, the scan reference voltage is charged to the first capacitor, and when the first switch is turned on, the sustain voltage is supplied to the other terminal of the driving signal output unit, and a sum of the sustain voltage and the scan reference voltage is supplied to one terminal of the driving signal output unit.

9. The plasma display apparatus of claim 7, further comprising a scan voltage supply unit connected between the voltage storing unit and the other terminal of the driving signal output unit.

10. The plasma display apparatus of claim 9, wherein the scan voltage supply unit includes two switches connected to a scan voltage source in parallel.

11. A plasma display apparatus comprising:

a plasma display panel including a scan electrode;

a sustain voltage supply unit that supplies a sustain voltage to the scan electrode;

a scan reference voltage supply unit that supplies a scan reference voltage to the scan electrode;

a scan reference voltage controller that is connected between the scan reference voltage supply unit and the scan electrode and includes a variable resistor changing the scan reference voltage into a reset signal with a predetermined slope;

a voltage storing unit that is connected between the sustain voltage supply unit and the scan reference voltage supply unit and stores the scan reference voltage; and a driving signal output unit that controls an output of a voltage supplied to the scan electrode using a single switch, wherein a first terminal of the variable resistor of the scan reference voltage controller is directly connected to the scan reference voltage supply unit and a second terminal of the variable resistor of the scan reference voltage controller is directly connected to the scan electrode and the driving signal output unit, and the single switch of the driving signal output unit controls current from the scan electrode and does not control current to the scan electrode.

12. The plasma display apparatus of claim 11, wherein at least one of a rising slope, a magnitude or supply time of the reset signal is adjusted by adjusting a resistance value of the variable resistor.

13. The plasma display apparatus of claim 11, wherein the scan reference voltage controller controls at least one of a rising slope, a magnitude or supply time of a reset signal supplied to the scan electrode in at least one subfield of a plurality of subfields to be different from at least one of a rising slope, a magnitude or supply time of a reset signal supplied to the scan electrode in the other subfields.

14. The plasma display apparatus of claim 13, wherein the variable resistor includes a plurality of variable resistors, and the plurality of variable resistors are connected to a plurality of scan electrode groups each including at least one scan electrode, respectively.

15. The plasma display apparatus of claim 14, wherein the scan reference voltage controller controls at least one of a rising slope, a magnitude or supply time of a reset signal supplied to at least one of the plurality of scan electrode groups to be different from at least one of a rising slope, a magnitude or supply time of a reset signal supplied to the other scan electrode groups.

16. The plasma display apparatus of claim 11, wherein the variable resistor includes a plurality of variable resistors, and the plurality of variable resistors are connected to a plurality of scan electrode groups each including at least one scan electrode, respectively.

17. The plasma display apparatus of claim 16, wherein the scan reference voltage controller controls at least one of a rising slope, a magnitude or supply time of a reset signal supplied to at least one of the plurality of scan electrode groups to be different from at least one of a rising slope, a magnitude or supply time of a reset signal supplied to the other scan electrode groups.

18. The plasma display apparatus of claim 11, wherein the driving signal output unit is a driver integrated circuit (IC) including the single switch connected to each of a plurality of scan electrodes.

19. The plasma display apparatus of claim 11, wherein the sustain voltage supply unit includes a sustain voltage source, a first switch whose one terminal is connected to the sustain voltage source, a second switch whose one terminal is commonly connected to the other terminal of the first switch and the voltage storing unit, a third switch whose one terminal is connected to the other terminal of the second switch, and a ground level voltage source connected to the other terminal of the third switch, and the voltage storing unit includes a first capacitor whose one terminal is commonly connected to the scan reference voltage supply unit and the scan reference voltage controller and the other terminal is connected between the first switch and the second switch, and a first diode connected to the first capacitor in parallel, and the scan reference voltage controller includes a fourth switch whose one terminal is connected to the scan reference voltage supply unit, and a the variable resistor whose one terminal is connected to the other terminal of the fourth switch and the other terminal is commonly connected to the scan electrode and one terminal of the driving signal output unit.

20. The plasma display apparatus of claim 19, wherein when the second switch and the third switch are turned on, the scan reference voltage is charged to the first capacitor, and when the first switch is turned on, the sustain voltage is supplied to the other terminal of the driving signal output unit, and a sum of the sustain voltage and the scan reference voltage is supplied to one terminal of the driving signal output unit.

21. The plasma display apparatus of claim 19, further comprising a scan voltage supply unit connected between the voltage storing unit and the other terminal of the driving signal output unit.

22. The plasma display apparatus of claim 21, wherein the scan voltage supply unit includes two switches connected to a scan voltage source in parallel.

23. The plasma display apparatus of claim 19, wherein the fourth switch of the scan reference voltage controller operates in a saturation region.

* * * * *